US007362874B2

(12) United States Patent
Lee et al.

(10) Patent No.: US 7,362,874 B2
(45) Date of Patent: Apr. 22, 2008

(54) SPEAKER SYSTEM HAVING A FRONT SPEAKER INTEGRATED WITH A REFLECTION-TYPE SURROUND SPEAKER

(75) Inventors: Jin Sub Lee, Suwon (KR); Takashi Ohyaba, Suwon (KR); Masao Gibo, Suwon (KR); Hyeon Goo Yoon, Suwon (KR)

(73) Assignee: Samsung Electronics Co., Ltd., Suwon-Si ( * ) Notice: Subject to any disclaimer, the term of this patent is extended or adjusted under 35 U.S.C. 154(b) by 831 days.

(21) Appl. No.: 10/744,502

(22) Filed: Dec. 21, 2003

(65) Prior Publication Data

US 2004/0136553 A1 Jul. 15, 2004

(30) Foreign Application Priority Data

Dec. 30, 2002 (KR) ..... 10-2002-0087218

(51) Int. Cl.
*H04R 5/02* (2006.01)

(52) U.S. Cl. ..... 381/307; 381/300

(58) Field of Classification Search ..... 379/307, 379/305, 304, 303, 300, 335, 160
See application file for complete search history.

(56) References Cited

U.S. PATENT DOCUMENTS 5,544,201 A * 8/1996 Hoshino et al. ..... 381/71.5
5,557,680 A * 9/1996 Janes ..... 381/300
5,809,150 A 9/1998 Eberbach
5,850,457 A * 12/1998 Gefvert ..... 381/300
7,092,541 B1 * 8/2006 Eberbach ..... 381/300

FOREIGN PATENT DOCUMENTS

KR 10-1992-0004775 B1 6/1992

* cited by examiner

*Primary Examiner*—Stella Woo
(74) *Attorney, Agent, or Firm*—Staas & Halsey LLP

(57) ABSTRACT

A surround speaker system according to the present invention includes an integral speaker in which a surround speaker is integrally formed with a front speaker, a canceling device for canceling a directly propagating sound of the surround speaker, and a reflective device for reflecting the output sound of the surround speaker.

5 Claims, 6 Drawing Sheets

SPEAKER SYSTEM HAVING A FRONT SPEAKER INTEGRATED WITH A REFLECTION-TYPE SURROUND SPEAKER

FIELD OF THE INVENTION

Generally, the present invention relates to a speaker system having a front speaker integrated with a reflection-type surround speaker.

BACKGROUND OF THE INVENTION

FIG. 1 and FIG. 2 respectively show exemplary speaker systems generally acceptable for a home theater.

In more detail, FIG. 1 illustrates a surround speaker system THX that has a surround speaker with bipolar characteristics of sound propagation, and FIG. 2 illustrates a Dolby AC-3 (or Dolby Digital) system that has a surround speaker with monopolar characteristics of sound propagation.

The two systems in the above FIGS. 1 and 2 have three speakers in common, i.e., first and second front speakers 1 and 2, and a center speaker 3. A subwoofer 4 is also commonly included in both systems.

They have a difference in the type of surround speakers. Firstly, the surround speaker system of FIG. 1 has left and right surround speakers 5 and 6 that have bipolar characteristics in their sound propagation. However, the surround speaker system of FIG. 2 has left and right surround speakers 8 and 9 that have normal (monopolar) characteristics in their sound propagation In addition, the surround speakers 5 and 6 shown in FIG. 1 are usually set at a height of about 1.5-3 m, and the surround speakers 8 and 9 shown in FIG. 2 are usually set at a height of about 60-80 cm.

In such acoustic systems for a home theater as above, the surround speakers 5 and 6 in FIG. 1 are disposed beside a listener and send their sound forward and rearward therefrom such that the listener may hear indirect (or reflected) sound thereof. To the contrary, the surround speakers 8 and 9 in FIG. 2 send their sound directly to a listener such that the listener may hear direct sound from the speakers 8 and 9.

Reference number 7 in FIGS. 1 and 2 denotes a screen that displays an image.

For installing surround speakers in such speaker system for a home theater according to the prior art, the surround speakers are disposed beside a listening position of a listener, and they are connected to an amplifier (not shown) or a receiver. That is, the surround speakers and the amplifier (or the receiver) are interconnected by a speaker line even though the surround speakers are far from the amplifier.

Therefore, for such an installation scheme of surround speakers, a long speaker line is required and such a long line is difficult to manage. Furthermore, the surround speakers are usually set at a height above the floor, which is cumbersome, and even-when they are laid on the floor, they consume floor space. In addition, installing separate surround speakers generates additional installation costs.

The information disclosed in this Background of the Invention section is only for enhancement of understanding of the background of the invention and should not be taken as an acknowledgement or any form of suggestion that this information forms the prior art that is already known in this country to a person of ordinary skill in the art.

SUMMARY OF THE INVENTION

The motivation for the present invention is to provide a speaker system having non-limiting advantages of reduced cost and saved room for establishing a surround system by forming a surround speaker integrally with a front speaker.

An exemplary speaker system according to an embodiment of the present invention includes an integral speaker, a canceling device, and a reflective device.

The integral speaker is connected to an amplifier which is connected to a screen for displaying an image. The integral speaker includes a case, a surround speaker disposed in the case such that an output sound of the surround speaker is propagated to a listening position by being reflected at a rear of the listening position, a front speaker disposed in the case such that an output sound of the front speaker is directly propagated to the listening position, and a wall member disposed between the surround speaker and the front speaker and dividing the case.

The canceling device cancels a directly propagating sound of the surround speaker such that the directly propagating sound is canceled before its propagation to the listening position.

The reflective device reflects the output sound of the surround speaker such that the output sound of the surround speaker is propagated to the listening position reflectively from the rear of the listening position.

In a further embodiment, the canceling device includes a sound absorbing member disposed in the case such that the sound absorbing member absorbs the directly propagating sound of the surround speaker. The sound absorbing member may be inclined with respect to a front side of the surround speaker and at least partially blocks the front side of the surround speaker.

In another further embodiment, the canceling device includes a DSP for receiving and processing the directly propagating sound of the surround speaker in order to cancel the directly propagating sound, the DSP being connected to the amplifier.

In a yet another further embodiment, the reflective device includes a wall of a room in which the integral speaker is disposed.

In a yet another further embodiment, the reflective device includes a reflective plate disposed at the rear of the listening position such that the output sound of the surround speaker is reflected at the rear of the listening position.

In a yet another further embodiment, the surround speaker includes a plurality of unit speakers aligned with respect to the wall member, the unit speakers having a predetermined spacing therebetween.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

An embodiment of the present invention will hereinafter be described in detail with reference to the accompanying drawings.

Figure 1:
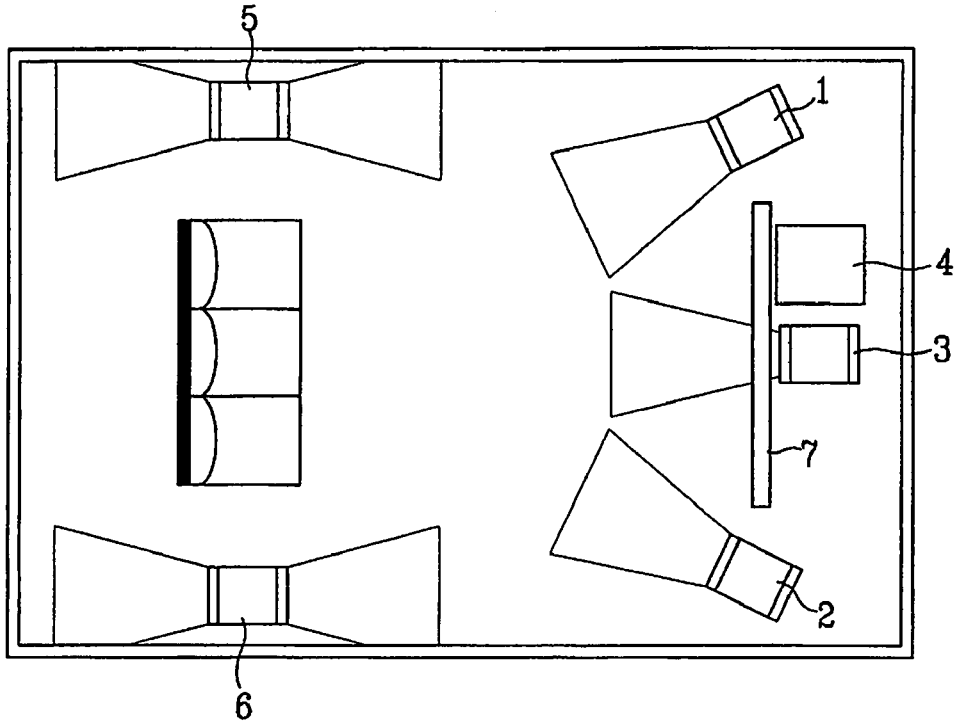
FIG. 1 PRIOR ART
FIG. 1 and FIG. 2 respectively show exemplary speaker systems generally acceptable for a home theater.
Figure 2:
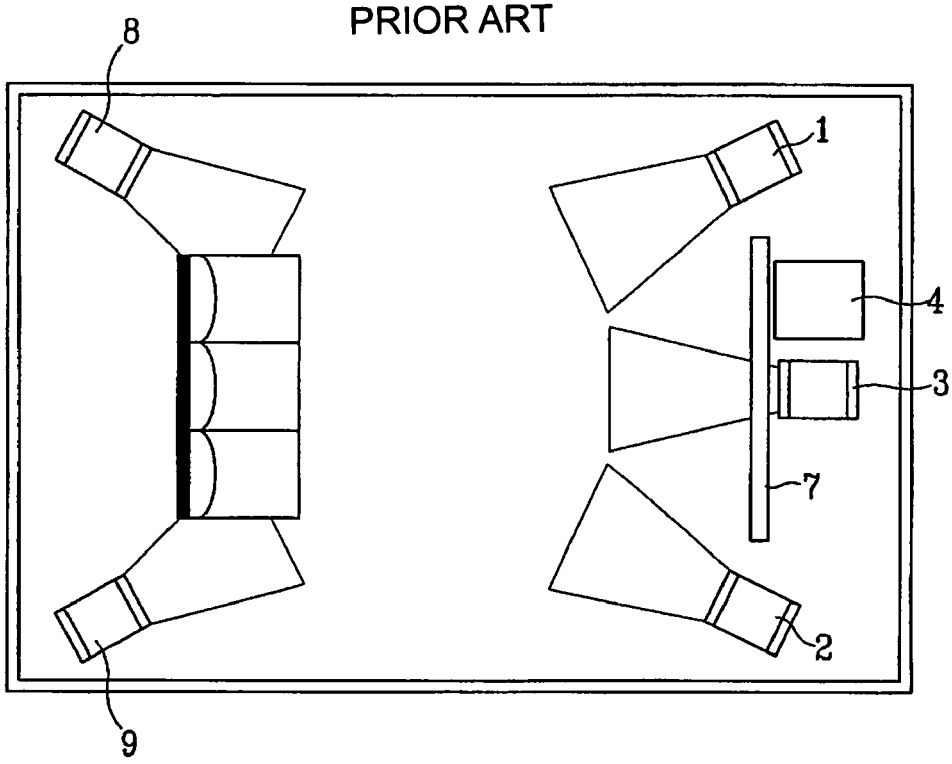
FIG. 2 PRIOR ART
Figure 3:
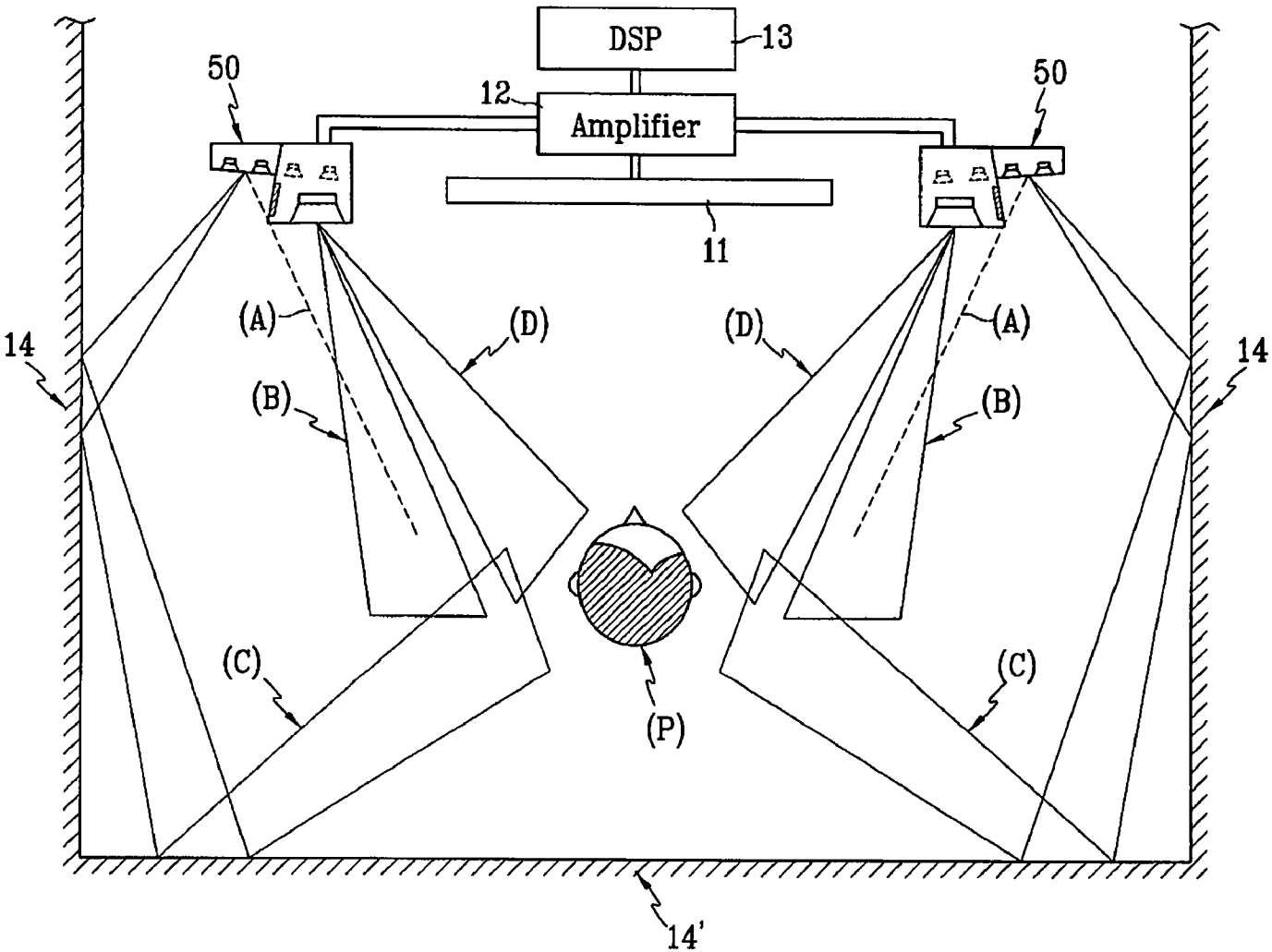
FIG. 3 is a schematic diagram showing a speaker system having an integral speaker in which a front speaker is integrated with a reflection-type surround speaker according to a first embodiment of the present invention.
Figure 4:
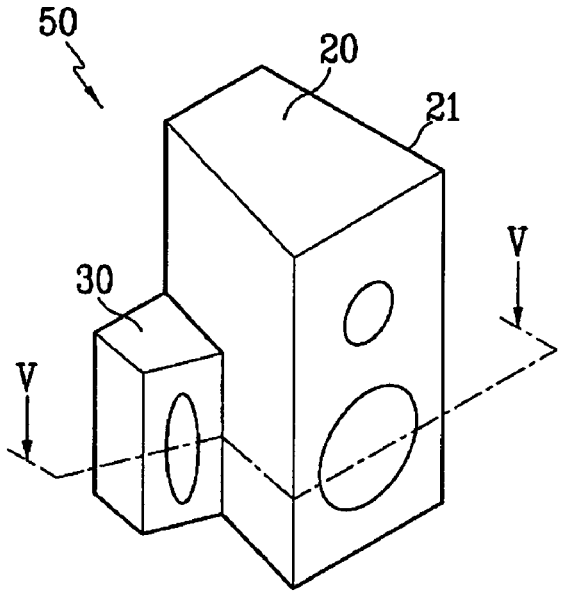
FIG. 4 illustrates an integral speaker according to an embodiment of the present invention.
Figure 5:
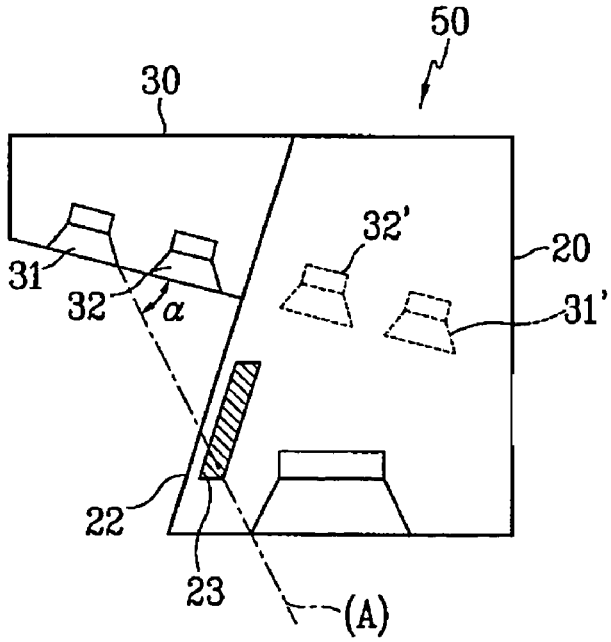
FIG. 5 is a sectional view along a line V-V of FIG. 4.

FIG. 3 is a schematic diagram showing a speaker system having a front speaker integrated with a reflection-type surround speaker according to a first embodiment of the present invention. FIG. 4 illustrates a front speaker integral with a reflection-type surround speaker according to an embodiment of the present invention. FIG. 5 is a sectional view along a line V-V of FIG. 4.

As can be seen in those drawings, a speaker system according to an embodiment of the present invention includes an integral speaker 50, which includes a front speaker integrated with a reflection-type surround speaker.

The integral speaker 50 is connected to an amplifier 12, which is in turn connected to a screen 11 for displaying an image.

The integral speaker 50 includes a case 21, a surround speaker 30, a front speaker 20, and a wall member 22.

The surround speaker 30 is disposed in the case 21 such that an output sound C of the surround speaker 30 is propagated to a listening position P after being reflected at a rear of the listening position P. The front speaker 20 is disposed in the case 21 such that an output sound D of the front speaker 20 is directly propagated to the listening position P. The wall member 22 is disposed between the surround speaker 30 and the front speaker 20, and it divides the case 21.

A speaker system having a front speaker integrated with a reflection-type surround speaker according to an embodiment of the present invention further includes a canceling device and a reflective device.

The canceling device cancels a directly propagating sound A (refer to FIG. 5) of the surround speaker 30, such that the directly propagating sound A is canceled before its propagation to the listening position P. The reflective device reflects the output sound of the surround speaker 30 such that the output sound of the surround speaker 30 is propagated to the listening position P reflectively from the rear of the listening position.

The canceling device includes a sound absorbing member 23 disposed in the case 21 such that the sound absorbing member 23 absorbs and accordingly cancels the directly propagating sound A of the surround speaker. In particular, as shown in FIG. 5, the sound absorbing member 23 is inclined with respect to a front side of the surround speaker 30 and at least partially blocks the front side of the surround speaker 30 from the listening position P.

In more detail, the sound absorbing member 23 is preferably installed at a position where it can most effectively absorb the directly propagating sound A of the surround speaker 30.

As shown in FIG. 5, the directly propagating sound A of the surround speaker 30 forms a propagation angle $\alpha$ with a front face of the speaker 30, in which the angle $\alpha$ has a preferable value of approximately 60°, as will be described in detail later. Therefore, the sound absorbing member 23 is installed at a position corresponding to such a propagation angle $\alpha$.

As a variation of an embodiment of the present invention, the canceling device includes a DSP (Digital Signal Processor) 13. The DSP 13 is connected to the amplifier 12 for canceling of the directly propagating sound A of the surround speaker 30.

Figure 7:
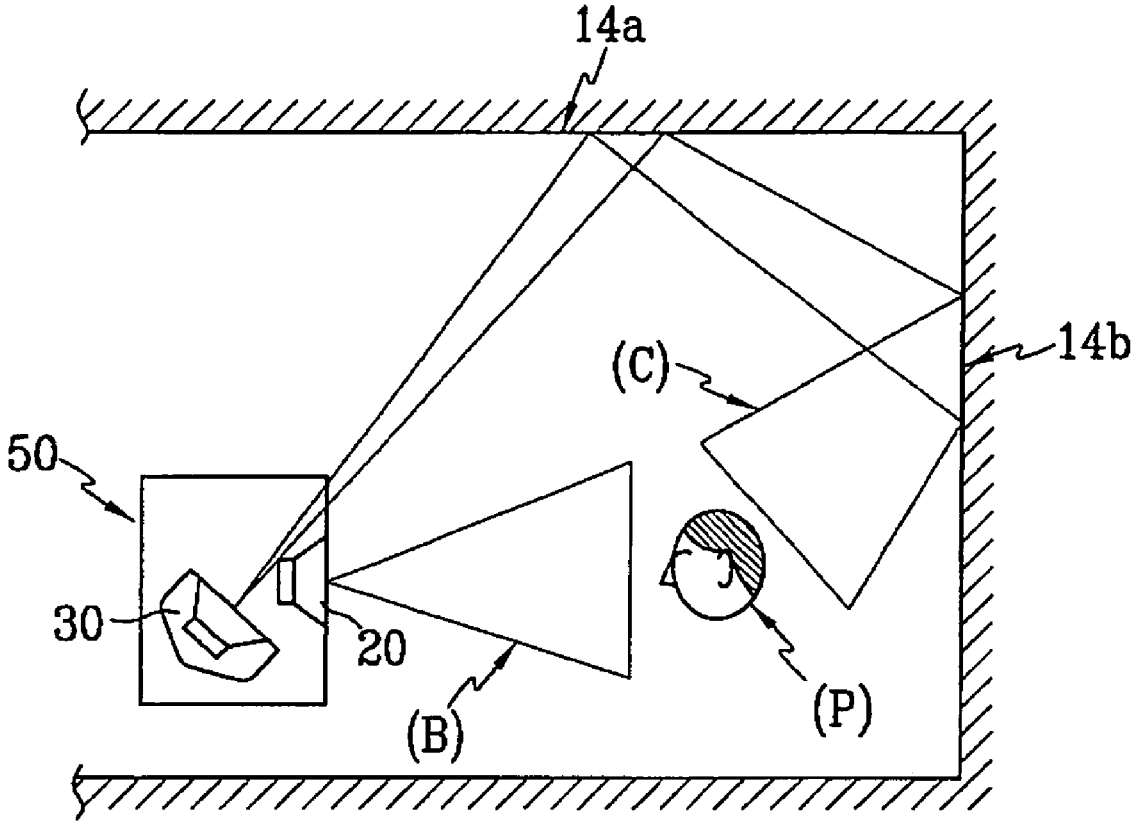
FIG. 7 illustrates a variation of sound propagation from a surround speaker according to a variation of setting position of an integral speaker according to an embodiment of the present invention.

In addition, as shown in FIGS. 3 and 7, the reflective device includes walls 14, 14', 14*a*, and 14*b* for defining a room in which the integral speaker 50 is installed.

Figure 6:
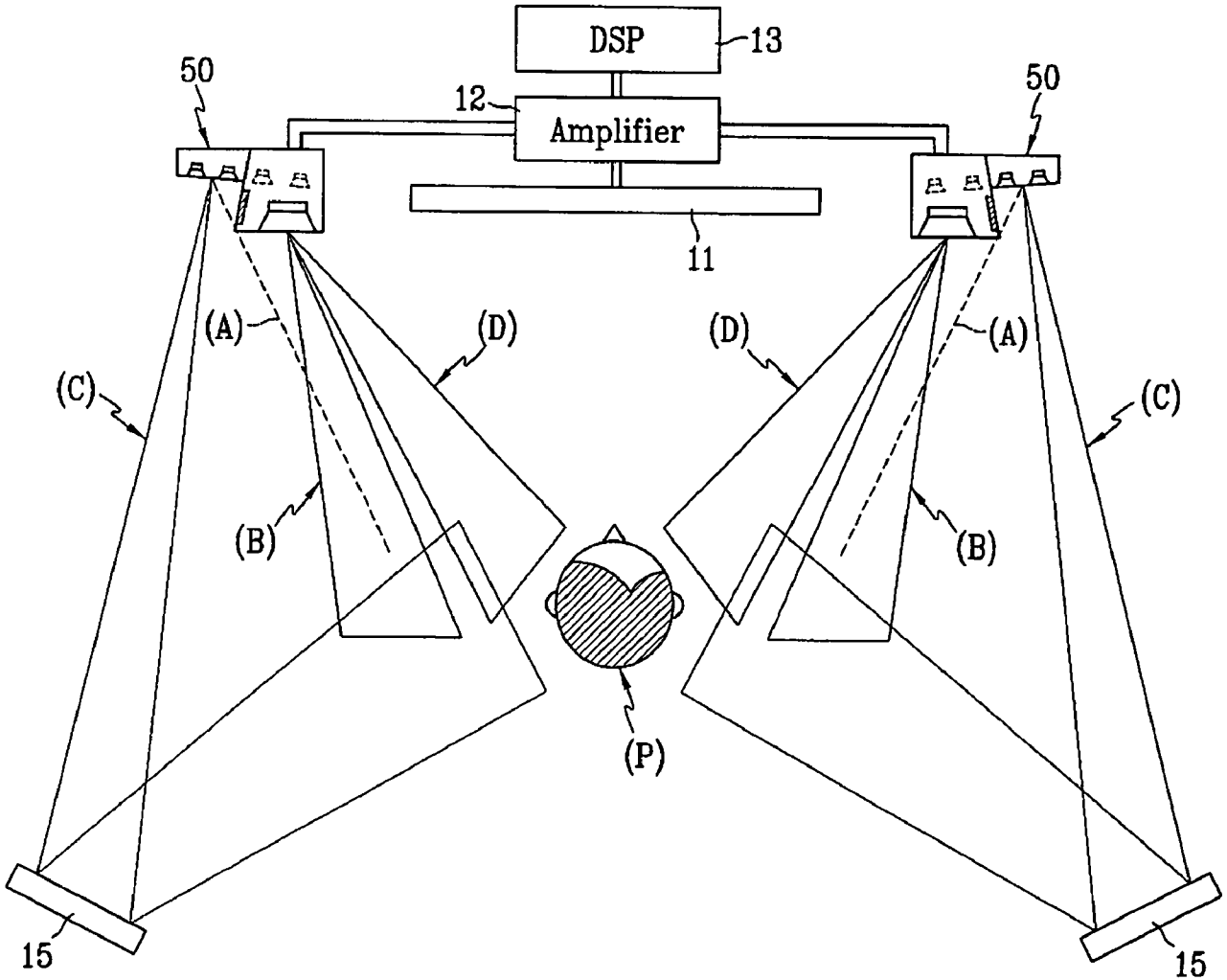
FIG. 6 is a schematic diagram showing a speaker system having an integral speaker according to a second embodiment of the present invention.

As a still further variation of the present embodiment, as shown in FIG. 6, the reflective device includes a reflective plate 15 disposed at the rear of the listening position P such that the output sound of the surround speaker 30 is reflected at the rear of the listening position P.

Referring back to FIG. 5, according to an embodiment of the present invention, a mirror image principle can be applied to the integral speaker 50. That is, the surround speaker 30 includes a plurality of unit speakers 31 and 32, e.g., one for a woofer and the other for a tweeter, aligned with respect to the wall member 22, the unit speakers having a predetermined spacing therebetween. Therefore, mirror speakers 31' and 32' are realized in the integral speaker 50.

An operation of a speaker system having a front speaker integrated with a reflection-type surround speaker according to an embodiment of the present invention is hereinafter described in detail.

An embodiment of the present invention utilizes an integral speaker 50 wherein a surround speaker 30 (a rear speaker according to the prior art) for a home theater is integrally formed with a front speaker 20. The integral speaker 50 is a directional speaker that enables an output sound C from the surround speaker 30 to reach the listening position P after reflecting at the rear thereof.

In more detail, as shown in FIG. 3, the output sound C from the surround speaker 30 reaches the listening position P after reflecting on the walls, i.e., a side wall 14 and a rear wall 14', or after reflecting on the reflective plate 15 shown in FIG. 6.

That is, the output sound C from the surround speaker 30 is generated and begins its propagation in front of the listening position P, but it reaches the listening position P after reflecting at the rear of the listening position P. Therefore, a listener at the listening position P hears the sound C as if the sound C is generated and propagated from the rear of the listening position P.

The output sound D from the front speaker 20 directly propagates to the listening position P. The sound absorbing member 23 absorbs, among output sounds of the surround speaker 30, the directly propagating sound A, which is of a low frequency band that attempts to directly propagate to the listening position P.

As a variation of such an embodiment, the DSP 13 receives the directly propagating sound A and processes signals of the sound A. The DSP 13 then generates a canceling sound B at the front speaker 20 such that the canceling sound B overlaps the directly propagating sound A and accordingly cancels it. Therefore, the directly propagating sound A does not reach the listening position P.

The output sound C of an intermediate or high frequency band reaches the listening position P after reflecting at the reflective device. Therefore, the integral speaker 50 acts as a directional speaker.

FIG. 7 illustrates a variation of sound propagation of an output sound C from a surround speaker 30 according to a variation of setting position of an integral speaker 50. In the case as shown in FIG. 7, the output sound C reaches the listening position P after reflecting at a ceiling 14*a* and a rear wall 14*b*.

Figure 8:
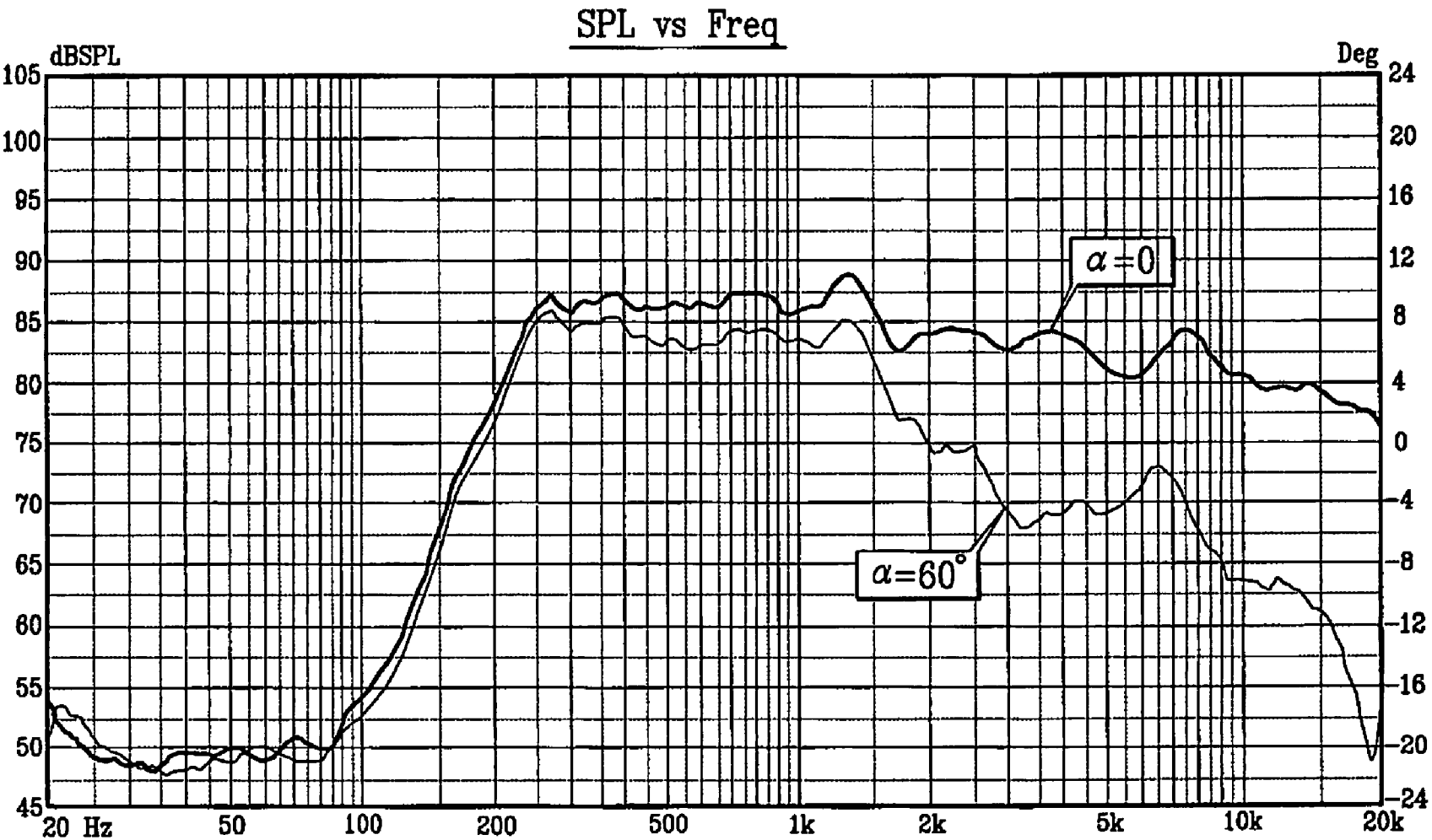
FIG. 8 is graphical illustration of a canceling effect of a directly propagating sound of a surround speaker by a sound absorbing member according to an embodiment of the present invention.

FIG. 8 is graphical illustration of a canceling effect of the directly propagating sound A of the surround speaker by a sound absorbing member in the cases that the angle $\alpha$ is about 0° and 60°. As shown in FIG. 8, the canceling effect becomes larger when the angle is $\alpha$ is about 60° than when the angel $\alpha$ is about 0°.

As described above, the following effect is achieved according to a speaker system having a front speaker integral with a reflection-type surround speaker according to an embodiment of the present invention.

Because a surround speaker is formed integrally with a front speaker, the surround speaker is not required to be installed separately, and therefore the speaker line for the surround speaker is not required, which eliminates a cost for the speaker line installation and cumbersome management of the speaker line. Therefore, such an integral speaker can be easily installed and reduces overall costs for a surround system.

Such a surround system saves room in installation, and can be easily managed due to a reduced number of speaker units.

In addition, since output sound of front speakers propagates directly to a listening position and output sound of surround speakers propagates thereto only after reflection, directivity of the integral speakers is enhanced, which accordingly enhances satisfaction of sound quality.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A speaker system comprising:

an integral speaker connected to an amplifier connected to a screen for displaying an image, the integral speaker comprising: a case; a surround speaker disposed in the case such that an output sound of the surround speaker is propagated to a listening position by being reflected at a rear of the listening position; a front speaker disposed in the case such that an output sound of the front speaker is directly propagated to the listening position; and a wall member disposed between the surround speaker and the front speaker and dividing the case;

a canceling device for cancelling a directly propagating sound of the surround speaker such that the directly propagating sound is canceled before its propagation to the listening position; and a reflective device for reflecting the output sound of the surround speaker such that the output sound of the surround speaker is propagated to the listening position reflectively from the rear of the listening position, wherein the canceling device comprises a sound absorbing member disposed in the case such that the sound absorbing member absorbs the directly propagating sound of the surround speaker, and wherein the sound absorbing member is inclined with respect to a front side of the surround speaker and at least partially blocks the front side of the surround speaker.

2. The speaker system of claim 1, wherein the canceling device comprises a DSP for receiving and processing the directly propagating sound of the surround speaker in order to cancel the directly propagating sound, the DSP being connected to the amplifier.

3. The speaker system of claim 1, wherein the reflective device comprises a wall of a room in which the integral speaker is disposed.

4. The speaker system of claim 1, wherein the reflective device comprises a reflective plate disposed at the rear of the listening position such that the output sound of the surround speaker is reflected at the rear of the listening position.

5. The speaker system of claim 1, wherein the surround speaker comprises a plurality of unit speakers aligned with respect to the wall member, the unit speakers having a predetermined spacing therebetween.

* * * * *

UNITED STATES PATENT AND TRADEMARK OFFICE

CERTIFICATE OF CORRECTION

PATENT NO. : 7,362,874 B2
APPLICATION NO. : 10/744502
DATED : April 22, 2008
INVENTOR(S) : Jin-Sub Lee et al.

It is certified that error appears in the above-identified patent and that said Letters Patent is hereby corrected as shown below:

Title Page, (73) Column 1 (Assignee), Line 2, after "Suwon-Si" insert --Republic of Korea--.

Signed and Sealed this

Twenty-sixth Day of August, 2008

JON W. DUDAS
*Director of the United States Patent and Trademark Office*